US006175222B1

(12) United States Patent
Adams et al.

(10) Patent No.: US 6,175,222 B1
(45) Date of Patent: Jan. 16, 2001

(54) SOLID-STATE HIGH VOLTAGE LINEAR REGULATOR CIRCUIT

(75) Inventors: Mark Adams, Arlington; James L. Cooper, Everett, both of WA (US)

(73) Assignee: ELDEC Corporation, Lynnwood, WA (US)

( * ) Notice: Under 35 U.S.C. 154(b), the term of this patent shall be extended for 0 days.

(21) Appl. No.: 09/513,288

(22) Filed: Feb. 24, 2000

Related U.S. Application Data

(62) Division of application No. 09/273,313, filed on Mar. 19, 1999, which is a continuation of application No. PCT/US96/15200, filed on Sep. 23, 1996.

(51) Int. Cl.[7] ..... G05F 1/59
(52) U.S. Cl. ..... 323/270; 323/273
(58) Field of Search ..... 323/270, 273

(56) References Cited

U.S. PATENT DOCUMENTS

| | | | | |
|---|---|---|---|---|
| 3,539,865 | * | 11/1970 | Billings | 317/16 |
| 3,569,784 | * | 3/1971 | Carroll | 317/16 |
| 3,579,036 | * | 5/1971 | McCoy | 317/16 |
| 4,054,933 | * | 10/1977 | Praeg | 361/57 |
| 4,232,351 | * | 11/1980 | Baker | 361/56 |
| 4,370,607 | * | 1/1983 | Dassonville | 323/271 |
| 4,698,582 | * | 10/1987 | Braun et al. | 323/285 |
| 4,893,070 | * | 1/1990 | Milberger et al. | 323/270 |
| 5,027,018 | * | 6/1991 | Kindlmann et al. | 307/571 |
| 5,043,598 | * | 8/1991 | Maeda et al. | 307/296.6 |
| 5,162,965 | * | 11/1992 | Milberger et al. | 361/56 |
| 5,196,980 | * | 3/1993 | Carson | 361/18 |
| 5,347,166 | * | 9/1994 | Schauder | 307/113 |
| 5,491,603 | * | 2/1996 | Birang et al. | 361/234 |
| 5,570,060 | * | 10/1996 | Edwards | 323/313 |
| 5,578,960 | * | 11/1996 | Matsumura et al. | 323/276 |
| 5,831,471 | * | 11/1998 | Nakajima et al. | 323/316 |
| 5,856,756 | * | 1/1999 | Sasahara et al. | 327/540 |
| 5,894,243 | * | 4/1999 | Hwang | 323/266 |
| 6,066,979 | * | 5/2000 | Adams et al. | 327/540 |

OTHER PUBLICATIONS

Cuthbert, "HV Crowbar Switches 2.4 MW ", Sep. 12, 1991, p. 144, Electronic Design.*

Cooper et. al.; "A Solid State High Voltage Crowbar Device Applicable to Helmet Mounted Display Rapid Disconnection"; Apr. 18–19, 1995; pp. 14–20; SPIE Proceedings, vol. 2465.*

* cited by examiner

*Primary Examiner*—Jeffrey Sterrett
(74) *Attorney, Agent, or Firm*—Christensen O'Connor Johnson Kindness PLLC

(57) ABSTRACT

A regulator circuit (10, 50) is connected to a high voltage generator (16, 52). The regulator circuit may be coupled to the generator in either a series or a shunt configuration. In the shunt configuration, the regulator circuit (10) varies the amount of current through a shunt resistor (R1) to change the output voltage provided to a load. The amount of current that is shunted by the regulator circuit is controlled by a feedback circuit consisting of a voltage divider (20) and an error amplifier (22). In the series configuration, the voltage across the regulator circuit (50) is added to the output from the high voltage generator. The current conducted through the regulator circuit therefore varies the summed output provided to the load.

8 Claims, 2 Drawing Sheets

SOLID-STATE HIGH VOLTAGE LINEAR REGULATOR CIRCUIT

This is a divisional of U.S. application Ser. No. 09/273,313, filed on Mar. 19, 1999, which was a continuation of International Application PCT/US96/15200, with an international filing date of Sep. 23, 1996.

FIELD OF THE INVENTION

The present invention relates generally to high voltage regulators, and more particularly to solid-state circuits for high voltage regulation.

BACKGROUND OF THE INVENTION

Many applications demand a regulated high voltage that is free from variations in voltage level. Designing an inexpensive and reliable circuit that provides a regulated high voltage, however, has proved to be problematic. While it has been recognized that it would be advantageous to use solid-state devices in a regulator circuit because of their low cost and small size, it has been difficult to design such a circuit. For example, although bipolar junction transistors (BJTs) have been used in the design of high voltage regulator circuits, the regulator circuits have failed to achieve the necessary performance for practical use. In certain circumstances, the current necessary to drive the bipolar junction transistors can exceed the actual load current being regulated. Moreover, bipolar junction transistors cannot tolerate overvoltages for an extended period. Based on the perceived shortcomings of bipolar junction transistors in specific, and solid-state devices in general, current regulators have therefore typically been constructed using different technologies.

SUMMARY OF THE INVENTION

The present invention provides a solid-state regulator circuit for regulating a high voltage in a controlled manner. The regulator circuit consists of multiple MOSFET transistor stages connected in cascade. In the preferred embodiment, a blocking diode is connected in parallel with each stage. Each stage in the regulator circuit can be biased on or off. When biased on, the stage provides a conductive path. When biased off, the stage acts as an open circuit up to the breakdown value of the blocking diode across each stage. The first stage in the regulator circuit is a current regulation stage that includes a current sense resistor in the conductive path of the regulator circuit. The stages coupled to the current regulation stage do not contain a sense resistor, and will hereinafter be referred to as the component stages.

In order to control the current flow through the regulator circuit, the current regulation stage is connected to a feedback circuit. The feedback circuit generates a signal that changes the bias point of a transistor in the current regulation stage. Changing the bias point of the transistor adjusts the amount of current that is flowing through the regulator circuit.

In accordance with one aspect of the invention, the regulator circuit may be connected to a high voltage generator in a shunt configuration. In the shunt configuration, the high voltage generator is connected to a load through a shunt resistor. The last component stage and the feedback circuit are connected at a point between the shunt resistor and the load. The current regulation stage is connected to ground. If the output from the high voltage generator exceeds a desired level, the feedback circuit adjusts the bias point of the current regulation stage to shunt additional current through the shunt resistor connected to the high voltage generator. The additional current causes a greater voltage drop through the resistor, charging the output voltage applied to the load. In this manner, the voltage applied to the load is regulated by charging the current through the shunt resistor.

In accordance with another aspect of the invention, the regulator circuit may be connected to a high voltage generator in a series configuration. In the series configuration, the component stages and the current regulation stage are connected in series with one of the output terminals from the high voltage generator. For example, the regulator circuit may be connected between ground and a first terminal of the high voltage generator that is floating with respect to ground. The feedback circuit is connected between a second terminal of the high voltage generator and the current regulation stage. Based on the monitored output voltage from the high voltage generator, the feedback circuit adjusts the amount of current flowing through the current regulation stage. In this manner, the output from the high voltage generator is maintained at a desired level.

In accordance with still another aspect of the invention, the series of discrete blocking diodes across the regulator circuit will avalanche at a known voltage rating. The blocking diodes provide a measure of overvoltage protection by entering into avalanche if a voltage across the regulator circuit exceeds the sum total of the avalanche ratings of the blocking diodes.

In accordance with still another aspect of the invention, the number of component stages can be varied to change the voltage that is regulated. Each component stage contributes to the regulation of a voltage roughly equivalent to the avalanche voltage rating of the blocking diode across the stage. The number of component stages may therefore be selected depending on the voltage that is to be regulated, allowing the regulator circuit to be simply and easily configured to operate in different environments.

An advantage of the disclosed regulator circuit is that it allows high voltages to be regulated using MOSFET transistors. MOSFET transistors are readily available, relatively inexpensive, displace a very small volume, and are of minimal weight. Constructing the regulator circuit using MOSFET transistor stages coupled in cascade therefore creates a very economical and small high voltage regulator.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
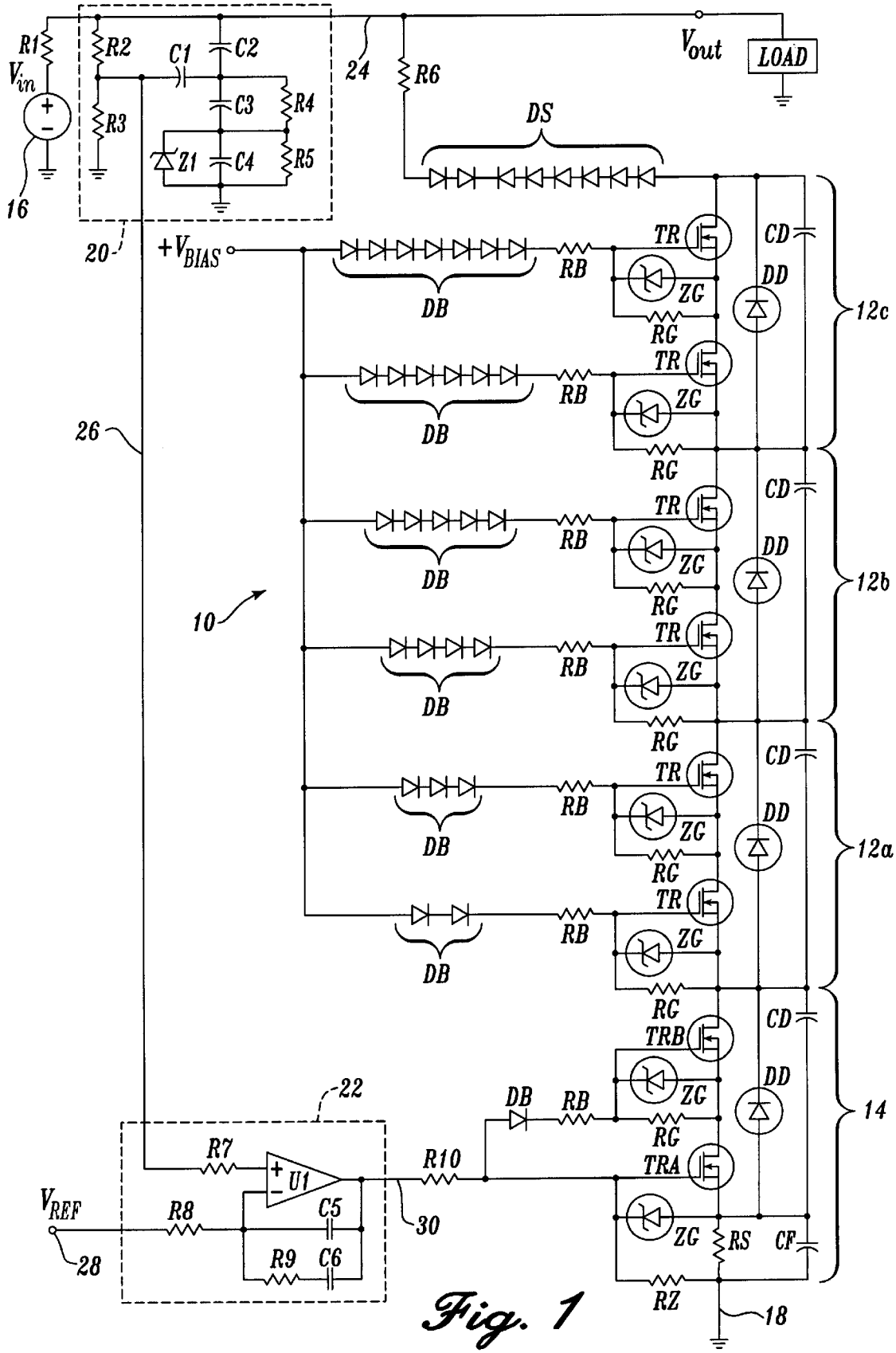
FIG. 1 is a schematic of a solid-state regulator circuit of the present invention connected in a shunt configuration.

FIG. 1 depicts the preferred embodiment of a regulator circuit 10 in accordance with the present invention. Regulator circuit 10 consists of a number of component stages 12*a*, 12*b*, and 12*c* connected in cascade with a current regulation stage 14. As will be described in additional detail below, the regulator circuit may operate in one of two states.

In an "off" state, the component stages 12*a*, 12*b*, and 12*c* and the current regulation stage 14 are initially biased off so that there is no conductive path provided through the regulator circuit. In an "on" state, the component stages and the current regulation stage are biased on so that a conductive path is provided through the regulator circuit. The amount of current that flows through the regulator circuit is controlled by the current regulation stage 14 in a manner that will be described below.

The regulator circuit 10 is depicted in FIG. 1 in a shunt configuration. One end of the regulator circuit 10 is connected between the output of a high voltage generator 16 and a load. The other end of the regulator circuit is connected to ground 18. A feedback circuit comprised of a voltage divider 20 and an error amplifier 22 is connected between the load and the current regulation stage 14. The feedback circuit monitors the output voltage supplied to the load, and changes the amount of current that is shunted by the regulator circuit 10 in order to maintain the output voltage at a desired level, i.e., provide an essentially constant voltage to the load despite variations that otherwise would affect the output voltage at terminal $V_{out}$.

Examining the feedback circuit in closer detail, the output voltage from the high voltage generator 16 is connected in series with a shunt resistor R1. The current flowing through shunt resistor R1 determines the output voltage at the load. That is, the voltage drop across the resistor is subtracted from the output voltage generated by the high voltage generator to determine the voltage applied to the load. The regulator circuit 10 therefore adjusts the current flowing through the shunt resistor in order to maintain a desired output voltage at the load.

The voltage divider 20 consists of a resistive and capacitive network that steps down the output voltage at the load. The voltage divider consists of a resistor R2 in series with a resistor R3 connected between line 24 and ground. Resistor R3 is preferably much smaller than resistor R2 so that the output voltage produced by the high voltage generator is greatly stepped down for use in the feedback circuit. A line 26 is connected to the point where resistor R2 connects with resistor R3. Line 26 provides the stepped-down voltage from the voltage divider to the error amplifier 22. The capacitive network includes capacitors C2, C3 and C4 connected in series between the output end of resistor R1 and ground, and an additional capacitor C1 connected between the junction of resistors R2 and R3 and the junction of capacitors C2 and C3. A resistor R4 is connected in parallel with capacitor C3. A resistor R5 and a Zener diode Z1 are connected in parallel with capacitor C4. The capacitive network provides instantaneous feedback information to the error amplifier. The capacitive coupling associated with the capacitive network increases bandwidth of the voltage divider. A provision which defeats the capacitive coupling allows capacitor C2 to charge upon initial circuit actuation is composed of components C3, Z1, C4, R4, R5. Zener Z1 performs the function of a switch providing a current shunt of smaller value capacitor C4 during the charging of C2. The Zener voltage is set for approximately five volts.

In an actual embodiment of the voltage divider, the components of the voltage divider have the following values:

| Component | Part Number or Rating |
|---|---|
| Resistor R2 | 500 Meg |
| Resistor R3 | 250K |
| Resistor R4 | 47 Meg |
| Resistor R5 | 47 Meg |
| Capacitor C1 | 0.01 μF |
| Capacitor C2 | 1000 pF |
| Capacitor C3 | 0.68 μF |
| Capacitor C4 | 0.10 μF |
| Zener Diode Z1 | IN6489, 4.74 |

The error amplifier 22 compares the stepped down output at the load with a reference voltage and produces an error signal that is proportional to the difference in the two voltage levels. The error amplifier consists of an operational amplifier U1 having the non-inverting input connected to line 26 through a resistor R7. The inverting input of operational amplifier U1 is coupled to a voltage reference ($V_{ref}$) terminal 28 through a resistor R8. The inverting input of the operational amplifier U1 is also connected to the output of the amplifier by a capacitor C5, and by the series connection of a resistor R9 and a capacitor C6. The voltage reference terminal is maintained at a reference voltage level that corresponds to the desired output at the load. In the preferred embodiment, the reference voltage is a stable DC voltage that does not fluctuate like the high voltage generator. The reference voltage may be supplied by a number of circuits, such as from an LH0070-2 device.

The voltage applied to the load is compared by the error amplifier 22 with the desired voltage as represented by the reference voltage on the $V_{ref}$ terminal. The error amplifier produces an error signal that is proportional to the difference between the desired voltage and the output voltage at the load. The error signal is provided to the current regulation stage 14 on a line 30. The slew rate of the error amplifier is slowed by the network consisting of capacitors C5, C6 and resistor R9, which filter any high frequency variations in the error signal. In an actual embodiment of the error amplifier, the components of the error amplifier have the following values:

| Component | Part Number or Rating |
|---|---|
| Resistor R7 | 10K |
| Resistor R8 | 10K |
| Resistor R9 | 100K |
| Capacitor C5 | 10 pF |
| Capacitor C6 | 0.01 μF |
| Operational Amplifier U1 | TL064, LM124 |
| Resistor R10 | 100Ω |

The output from the error amplifier 22 is connected to the current regulation stage 14 of the regulator circuit 10 through a resistor R10. The current regulation stage is constructed around a pair of transistors TRA and TRB, preferably both MOSFETs. A sense impedance, preferably a sense resistor RS, is connected between the source of transistor TRA and ground 18. The sense resistor RS is selected to have a peak power capability sufficient to conduct the desired current when the regulator circuit is turned on. A diode DD and a capacitor CD are connected between the source of transistor TRA and the drain of transistor TRB. A capacitor CF is also connected in parallel with the sense resistor RS.

Transistors TRA and TRB are both biased by the error signal produced by the error amplifier. A resistor RG and a Zener diode ZG are connected in parallel between the gate and source of transistor TRB. Resistor RG and Zener diode ZG are selected to prevent the transistor from conducting due to leakage current during biased-off operation, to protect the transistor from gate-to-source stress during biased-on operation, and to allow the desired gate-to-source voltage to turn the transistor on when a conductive path is generated through the regulator circuit. The gate of transistor TRA is connected in series with a diode DB and a resistor RB. Diode DB is selected to ensure that reverse current will not flow from the current regulation stage. Resistor RB is sized to limit the current flow into the transistor when the regulator circuit is turned on. In an actual embodiment of the regulator circuit, which is designed to regulate an approximate 10,000 volts output, the circuit elements for the current regulation stage are as follows:

| Component | Part Number or Rating |
|---|---|
| Diode DD | BYD37M |
| Capacitor CD | 10 pF |
| Transistors TRA | 1RFR020, MTD IN80E |
| Zener diode ZG | BZX84015, 15 V |
| Resistor RG | 10 K ohm |
| Diode DB | BYD37M |
| Resistor RB | 1 K ohm |
| Resistor RS | 1 K ohm |
| Capacitor CF | 0.01 $\mu$F |
| Resistor RZ | 4.99 K ohm |

The drain of transistor TRB is connected to the first component stage 12*a*. It is noted that each component stage 12*a*, 12*b* and 12*c* is constructed with the same circuit elements. For purposes of this description, a generic component stage 12*a* will therefore be discussed as representative of all of the component stages. Component stage 12*a* is constructed around a pair of transistors TR, which in the preferred embodiment of this circuit are a pair of MOSEFETs connected in cascade. Component stage 12*a* is similar to the current regulation stage, in that both stages are constructed around a pair of transistors. The component stages do not, however, contain a sense resistor in the conductive path. A diode DD and a capacitor CD are connected across the transistors TR. Diode DD and capacitor CD serve the same functions as the corresponding components in the current regulation stage, that is, they are selected to provide overvoltage protection for the circuit. A Zener diode ZG and a resistor RG are also connected across the gate and source of each transistor. The Zener diode ZG and the resistor RG also serve the same roles as they do in the current regulation stage.

The gate of each transistor TR in the component stage is connected to a biasing voltage through a resistor RB and a diode string DB. The diode string DB contains a different number of diodes for each transistor in the component stages. In order to ensure that only one component stage operates in a linear mode, the number of diodes within the diode string associated with a particular component stage increases by one for each transistor within the stage. Thus, in the representative regulator circuit depicted in FIG. 1, component stage 12*a* contains diode strings having two and three diodes, component stage 12*b* contains diode strings having four and five diodes, and component stage 12*c* contains diode strings having six and seven diodes. Before turning on, the voltage drop across the component stage must therefore exceed the voltage drop required to turn on the previous component stage by a value equal to the voltage drop across one diode DB. This method has the advantage of producing additional output stability due to the required voltage drop increase for conduction of an additional transistor.

The drain of the transistor TR in the last component stage 12*c* is connected to the output voltage line 24 through the series connection of diode string DS and a resistor R6. Diode string DS is a string of Zener diodes that allow the output voltage at the load to exceed the voltage level that may be shunted by the component stages and current regulation stage alone. The diode string drops a fixed voltage providing a lower voltage at the component stages. The number of diodes within the diode string may therefore be changed rather than requiring the addition of component stages in certain applications.

Before the regulator circuit is turned on, all the component stages are nonconducting. The biasing potential provided to each of the component stages is sufficient to raise the potential at the gates of the component stage transistors TR so that they will become biased on when the gate-to-source turn-on voltage for each transistor is exceeded by a voltage across resistor RG. That is, each transistor TR will become biased on when the current flow through the associated resistor RG causes a voltage drop across the resistor that exceeds the turn-on voltage of each transistor. When biased off, the resistance of each component stage exceeds one gigaohm. The regulator circuit therefore acts as an open circuit.

The regulator circuit is turned on when the high voltage generator begins to generate an output voltage on line 24. The high voltage at the load is stepped down by the voltage divider 20 and compared by the error amplifier 22 with the reference voltage level. The error signal generated by the error amplifier is applied to the current regulation stage 14, biasing transistor TRA so that it begins to conduct current through the sense resistor RS. After transistor TRA is biased on, a current path is provided through diode DB, resistor RB, and resistor RG of the directly adjacent transistor TRB, and through the current regulation stage transistor TRA and the sense resistor RS to ground. When the voltage across resistor RG rises sufficiently above the gate-to-source potential threshold of transistor TRB, the transistor is biased on.

The turning-on process repeats for the transistors TR in the component stages. The transistors TR in each component stage remain biased off, and non-conducting, until the transistors in the component stage that is located nearer to the current regulation stages enter into conduction. The number of transistors TR that are biased on depends on the current through the current regulation stage 14. Depending on the current being shunted, some, but not necessarily all of the transistors in the component stages will be biased on. One transistor TR will operate in a linear mode. The transistors TR closer to the current regulation stage will operate in saturation. The transistors TR higher in the component stack will remain biased off, however the current will flow through the blocking diodes DD around the biased off transistors. The conductive path through the regulator circuit during operation therefore extends through the avalanching diodes DD, through the transistor TR operating in linear operation, through the transistors TR operating in saturation, and through the current regulation stage to ground 14. The transistor operating in a linear mode will change depending on the current being shunted. Ultimately, current is shunted through the regulator circuit 10 to maintain the output voltage at a desired level. When this occurs, current will be shunted through the regulator circuit 10 away from the load connected to output line 24.

The amount of current that is shunted away from the load depends on the biasing point of the current regulation stage 14. The biasing point of the current regulation stage is adjusted by the changing voltage applied to the current regulation stage by the error amplifier 22. The reference voltage $V_{ref}$ is selected so that the output from the high voltage generator 16 is regulated at a desired level. In this manner, the amount of current through the current regulation stage is closely controlled.

While three component stages 12*a*, 12*b* and 12*c* are depicted in FIG. 1, it will be appreciated that a greater or lesser number of component stages may be included within the regulator circuit. Each component stage contributes to regulating a voltage equal to the maximum avalanche voltage of the blocking diode for that stage. The diode ratings of each component stage and the current regulation stage are therefore used to determine the number of component stages necessary to regulate a particular voltage. For example, if the regulator circuit were to regulate 6,000 volts, and if blocking diodes DD rated at 1,000 volts were used in the regulator circuit, a total of five component stages would be required in the regulator circuit. The total avalanche voltage of the five blocking diodes in the component stages and the single blocking diode in the current regulation stage would add to a number approximating the required regulated voltage of 6,000 volts. It will be appreciated that a greater or lesser number of component stages could be used to select the regulated voltage of the regulator circuit. Moreover, diodes having different ratings may also be selected to change the regulated voltage capability. As noted above, the number of Zener diodes in the diode string DS may also be changed to reduce the number of required component stages.

The regulator circuit 10 disclosed in FIG. 1 is advantageous in that it uses solid-state MOSFETs to regulate high voltages. Using MOSFETs reduces the cost of the regulator circuit, allows the regulator circuit to be incorporated into a very small package, and allows the regulator circuit to operate reliably in high voltage applications.

Figure 2:
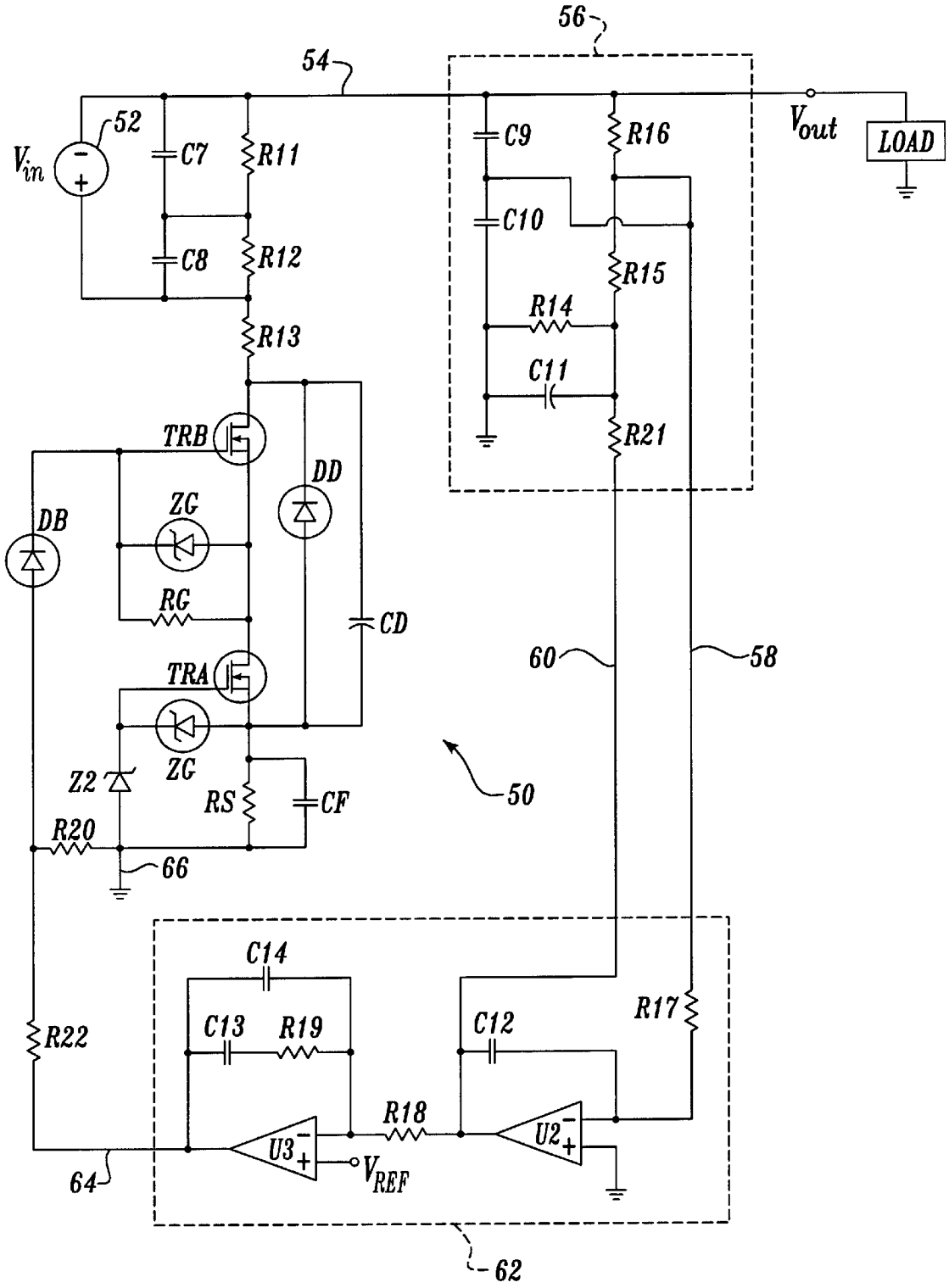
FIG. 2 is a schematic of a solid-state regulator circuit of the present invention connected in a series configuration.

FIG. 2 depicts an alternative embodiment of a regulator circuit 50 in a series configuration with a high voltage generator 52. The high voltage generator 52 is in a floating configuration, wherein the generator is not grounded. The construction and operation of the regulator circuit 50 is similar to the regulator circuit 10 depicted in FIG. 1. The operation of the regulator circuit will therefore be broadly described, with the reader directed to the corresponding text of FIG. 1 for additional details.

The high voltage generator 52 is connector to a load by a line 54, and to the regulator circuit 50 by a line 53. Unlike the regulator circuit 10 shown in FIG. 1 which contained multiple component stages, the regulator circuit 55 shown in FIG. 2 contains only a single current regulation stage 55. The current regulation stage is constructed around a pair of transistors TRA and TRB, preferably both MOSFETs. A sense impedance, preferably a sense resistor RS, is connected between the source of transistor TRA and ground 66. The sense resistor RS is selected to have a peak power capability sufficient to conduct the desired current when the regulator circuit is turned on. A diode DD and a capacitor CD are connected between the source of transistor TRA and the drain of transistor TRB.

The current regulation stage 55 operates in the same manner as does the current regulation stage in the regulator circuit 10 depicted in FIG. 1. The current regulator stage is connected to a feedback circuit consisting of an error amplifier 62 and a voltage divider 56. The voltage divider 56 is coupled to the output line 54 that extends from the high voltage generator to the load. The voltage divider 56 generates a signal on a line 58 that is proportional to the output voltage produced by the high voltage generator. The stepped-down signal is provided on line 58 to the error amplifier 62.

The error amplifier 62 compares the stepped-down voltage signal with a reference voltage $V_{ref}$. The error amplifier contains an operational amplifier U2 that acts as an inverting buffer. The output from operational amplifier U2 is provided to operational amplifier U3, which operates as a comparator to compare the measured voltage level on the output line 54 with a voltage reference $V_{ref}$. An error signal is generated that is proportional to the difference between the measured voltage on the output line 54 and the reference voltage $V_{ref}$, and provided to the current regulation stage 55 on a line 64.

The error signal changes the biasing point of transistor TRA, controlling the amount of current that is conducted through the current regulation stage. The impedance of the current regulation stage varies with the current flow through the stage. Since the current regulation stage 55 is coupled in series with the high voltage generator 52, the voltage drop across the current regulation stage will be summed with the voltage generated by the high voltage generator. By changing the amount of current that flows through the current regulation stage, the output voltage provided to the load is also changed. In this manner, the output voltage applied to the load is closely regulated.

Those skilled in the art will appreciate that additional circuitry is present within the feedback circuit of the regulator circuit 50 to minimize noise, slow the response of the feedback circuit, and prevent oscillations in the output from the high voltage generator. Those skilled in the art will also appreciate that additional component stages may be added to the current regulation stage 55 if higher voltages are to be regulated. The use of the regulator circuit 50 in a series configuration allows the high voltage generator 52 to remain floating.

While the preferred embodiment of the invention has been illustrated and described, it will be apparent that various changes can be made therein without departing from the spirit and scope of the invention.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A solid-state high voltage regulator circuit for supplying a regulated voltage to a load, the solid-state high voltage regulator circuit comprising:

(a) an output terminal coupled to the load;

(b) a high voltage generator having a first lead and a second lead, the first lead being coupled to the load, wherein the high voltage generator is configured to generate a high voltage between the first and second leads;

(c) a voltage divider coupled to the output terminal, wherein the voltage divider is configured to provide a stepped-down voltage indicative of a voltage at the output terminal;

(d) an error amplifier coupled to receive the stepped-down voltage and a reference voltage, wherein the error amplifier is configured to generate a control signal indicative of a difference in level between the stepped-down voltage and the reference voltage; and (e) a regulator stage having a control lead coupled to the error amplifier, having an input lead coupled to the second lead of the high voltage generator and having an output lead coupled to a ground terminal, wherein, in response to the control signal, the regulator stage is configured to adjust a regulator current flowing between the input and output leads of the regulator stage, thereby causing a voltage across the regulator stage to be correspondingly adjusted so that the voltage between the output and ground terminals is maintained at a desired preselected level.

2. The solid-state high voltage regulator circuit of claim 1, wherein the regulator stage comprises an input lead, an output lead and a regulated current path therebetween, the regulator current flowing in the regulated current path, wherein the regulator stage is configured to adjust the regulated current in response to the control signal.

3. The solid-state high voltage regulator circuit of claim 2, wherein the regulator stage includes a field effect transistor with its channel region coupled between the input and output leads of the regulator stage, the channel region forming at least part of the regulated current path.

4. The solid-state high voltage regulator circuit of claim 3, wherein the regulator stage further comprises a shunting circuit coupled between the input and output leads of the regulator stage, the shunting circuit being configured to provide a current path bypassing the field effect transistor when an overvoltage condition occurs across the regulator circuit.

5. The solid-state high voltage regulator circuit of claim 2, wherein the regulator stage is configured to decrease the current flowing through the regulated current path when the voltage level at the output terminal exceeds the preselected level to decrease the between the input and output leads of the regulator stage, thereby causing the voltage between the output and ground terminals to decrease.

6. The solid-state high voltage regulator circuit of claim 5, wherein the regulator stage is configured to increase the current flowing through the regulated current path when the voltage level at the output terminal is below the preselected level to increase the voltage between the input and output leads of the regulator stage, thereby causing the voltage between the output and ground terminals to increase.

7. The solid-state high voltage regulator circuit of claim 1, wherein the first and second leads of the high voltage generator respectively have negative and positive potentials.

8. The solid-state high voltage regulator circuit of claim 7, wherein the error amplifier comprises an inverting buffer and a comparator, the inverting buffer being coupled to receive the stepped-down voltage, the comparator being coupled to receive the inverted stepped-down voltage from the inverting buffer and the reference voltage, the comparator being configured to generate the control signal as a function of the difference between the reference voltage and the inverted stepped-down voltage.

* * * * *

UNITED STATES PATENT AND TRADEMARK OFFICE

CERTIFICATE OF CORRECTION

PATENT NO. : 6,175,222 B1
DATED : January 16, 2001
INVENTOR(S) : M. Adams et al.

It is certified that error appears in the above-identified patent and that said Letters Patent is hereby corrected as shown below:

| COLUMN | LINE | |
|---|---|---|
| 10 | 5 | "the betweeen" should read --the voltage between-- (Claim 5, line 5) |

Signed and Sealed this

Fifth Day of June, 2001

Nicholas P. Godici

NICHOLAS P. GODICI

*Acting Director of the United States Patent and Trademark Office*

*Attest:*

*Attesting Officer*